US007815265B2

(12) United States Patent
Lee

(10) Patent No.: US 7,815,265 B2
(45) Date of Patent: Oct. 19, 2010

(54) RACK APPARATUS OF DISHWASHER

(75) Inventor: Gang-Hyun Lee, Gyeongsangnam-Do (KR)

(73) Assignee: LG Electronics Inc., Seoul (KR)

( * ) Notice: Subject to any disclaimer, the term of this patent is extended or adjusted under 35 U.S.C. 154(b) by 59 days.

(21) Appl. No.: 12/203,756

(22) Filed: Sep. 3, 2008

(65) Prior Publication Data

US 2009/0058238 A1 Mar. 5, 2009

(30) Foreign Application Priority Data

Sep. 5, 2007 (KR) ..... 10-2007-0090135

(51) Int. Cl.
*A47B 81/04* (2006.01)
*A47L 15/50* (2006.01)

(52) U.S. Cl. ..... 312/228.1; 211/41.8; 134/56 D

(58) Field of Classification Search ..... 312/228.1, 312/410, 330.1, 334.1, 334.7, 334.16; 211/41.8, 211/41.9; 126/337 R, 339; 134/135, 137, 134/56 D See application file for complete search history.

(56) References Cited

U.S. PATENT DOCUMENTS 1,414,858 A * 5/1922 Brown ..... 119/322
1,851,192 A * 3/1932 Lange ..... 126/339
1,995,399 A * 3/1935 Reedy et al. ..... 126/339
2,048,212 A * 7/1936 Goulooze ..... 312/408
2,635,760 A * 4/1953 Nicholas ..... 211/41.8
2,937,765 A * 5/1960 Shank ..... 108/143
3,160,448 A * 12/1964 Abernathy et al. ..... 384/23
3,791,371 A * 2/1974 Oatley ..... 126/339
5,303,997 A * 4/1994 Kropf ..... 312/334.4
6,824,232 B2 * 11/2004 Farmer ..... 312/293.2

FOREIGN PATENT DOCUMENTS

JP 60-123167 U 8/1985
JP 2003-325427 A 11/2003

* cited by examiner

*Primary Examiner*—James O Hansen
(74) *Attorney, Agent, or Firm*—Birch, Stewart, Kolasch & Birch, LLP

(57) ABSTRACT

A rack apparatus of a dishwasher disclosed, the apparatus comprising a rack disposed in the dishwasher for washing targets to be washed contained in a wash tub and configured to receive the targets to be washed, rack rails fixedly installed at the rack, and rail guides each having a plurality of rail supporting portions longitudinally disposed at the wash tub and configured to slidably support the rack rails. A rack apparatus of a dishwasher disclosed in another aspect comprises a rack disposed in the dishwasher for washing targets to be washed contained in a wash tub and configured to receive the targets to be washed, rack rails fixedly installed at the rack, and rail guides each having a plurality of rail supporting portions longitudinally disposed at the wash tub and configured to slidably support the rack rails, wherein the rack rails are simultaneously coupled to two or more rack rail supporting portions. Accordingly, the height of the rack can easily be adjusted according to requirements, such as dishes to be contained in the rack, the rack can move more safely, and the weight of dishes to be contained in the rack can increase.

11 Claims, 6 Drawing Sheets

RACK APPARATUS OF DISHWASHER

RELATED APPLICATION

The present disclosure relates to subject matter contained in priority Korean Application No. 10-2007-0090135, filed on Sep. 5, 2007, which is herein expressly incorporated by reference in its entirety.

BACKGROUND OF THE INVENTION

1. Field of the Invention

The present invention relates to a dishwasher, and particularly, to a rack apparatus of a dishwasher.

2. Background of the Invention

A dishwasher is a machine for washing garbage remaining on a dishware (e.g., dishes, cups, bowls and the like) by injecting a high pressure of washing water onto the dishes contained in a wash tub or washing chamber. Such dishwasher is configured such that dishes are washed using washing water containing detergent and the washed dishes are dried.

The dishwasher typically has a rack for containing dishes. The rack can be extended or retracted forwardly or backwardly along rack guides of the wash tub. The extension or retraction of the rack is implemented by a sliding motion of the rack with respect to the rack guides.

However, the related art dishwasher has been configured to have a fixed height of the rack received in the wash tub. Thus, it was not easy to adjust the height of the rack, resulting in an inconvenience of receiving dishes in different sizes.

In particular, for a small dishwasher having a wash tub with a relatively small space, a difficulty in adjusting the height of the rack has caused a degradation of space utilization, and thereby it was difficult to contain dishes in the wash tub.

Furthermore, the related art dishwasher has been configured such that the rack is supported by the rack guides of the wash tub. Accordingly, a limitation on the supporting force of the rack guides restricts the weight of dishes capable of being contained in the rack.

SUMMARY OF THE INVENTION

Therefore, an object of the present invention is to provide a rack apparatus of a dishwasher capable of adjusting a height of a rack within a wash tub.

Another object of the present invention is to provide a rack apparatus of a dishwasher having a structure capable of improving a supporting force of a rack coupled to a wash tub.

To achieve these and other advantages and in accordance with the purpose of the present invention, as embodied and broadly described herein, there is provided a rack apparatus of a dishwasher including a rack disposed in the dishwasher for washing targets to be washed contained in a wash tub and configured to receive the targets to be washed, rack rails fixedly installed at the rack, and rail guides each having a plurality of rail supporting portions longitudinally disposed at the wash tub and configured to slidably support the rack rails.

In another aspect of the present invention, a rack apparatus of a dishwasher may include a rack disposed in the dishwasher for washing targets to be washed contained in a wash tub and configured to receive the targets to be washed. rack rails fixedly installed at the rack, and rail guides each having a plurality of rail supporting portions longitudinally disposed at the wash tub and configured to slidably support the rack rails, wherein the rack rails are simultaneously coupled to two or more rack rail supporting portions.

According to a rack apparatus of a dishwasher of the present invention, a plurality of rail grooves formed in rail guides installed at the wash tub can be engaged with rack rails formed at a rack, so as to enable an adjustment of the height of the rack. Thus, the height of the rack can easily be adjusted according to requirements, such as sizes of dishes to be contained in the rack.

Also, in the rack apparatus of the dishwasher, as the plurality of rail grooves are engaged with the rack rails, the load of the rack can be divided and supported at least two portions of the rail guides. Therefore, the supporting force for the rack can be enhanced, which allows the rack to move more safely, thereby increasing the weight of dishes to be contained in the rack.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE INVENTION

Description will now be given in detail of a rack apparatus in a dishwasher according to the preferred embodiments of the present invention, with reference to the accompanying drawings.

Figure 1:
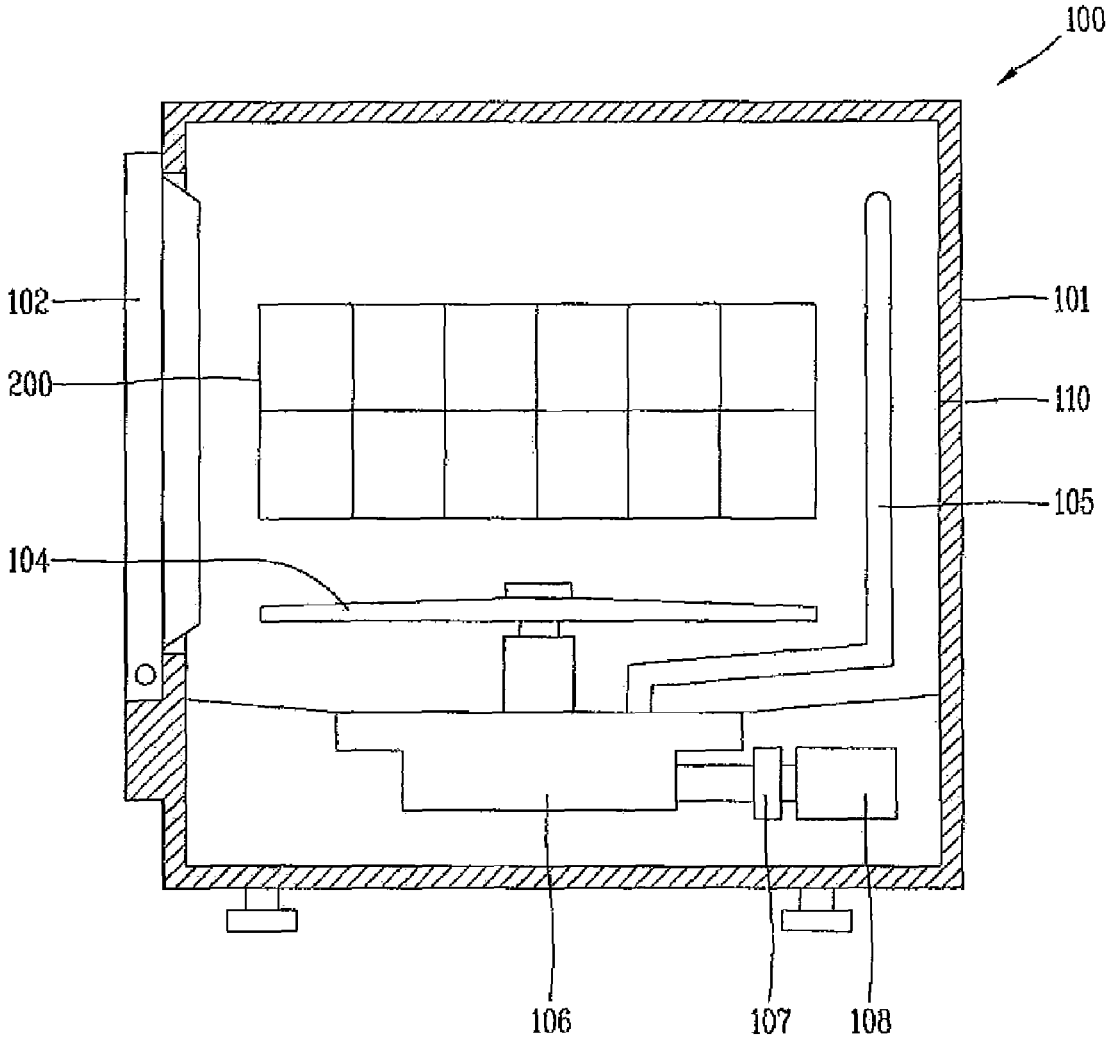
FIG. 1 is a schematic view of a dishwasher in accordance with a first exemplary embodiment of the present invention.

FIG. 1 is a schematic view of a dishwasher in accordance with a first exemplary embodiment of the present invention.

As shown in FIG. 1, a dishwasher according to a first exemplary embodiment may include a wash tub 110 installed inside a casing 101, a door 102 for opening/closing the wash tub 110, and a rack 103 installed in the wash tub 110 for containing a dishware (e.g., dishes, cups, bowls, and the like).

Also, the dishwasher 100 may further include a sump 106 installed in a lower portion of the wash tub 110 for containing washing water, an impeller 107 configured to pump the washing water contained in the sump 106, and a washing motor 108 for driving the impeller 107.

The dishwasher 100 may further include a nozzle apparatus 105 and a rotary nozzle 104 all for injecting washing water pumped from the sump 106 onto the dishes to be washed. The nozzle apparatus 105 is fixed to a rear side of the wash tub 110 to inject washing water onto the dishes. The rotary nozzle 104 is rotated by an injection pressure of washing water below the rack 103, thus to inject washing water onto the dishes. By injecting the washing water, garbage on the dishes can be removed and thusly the dishes can be washed up.

Figure 2:
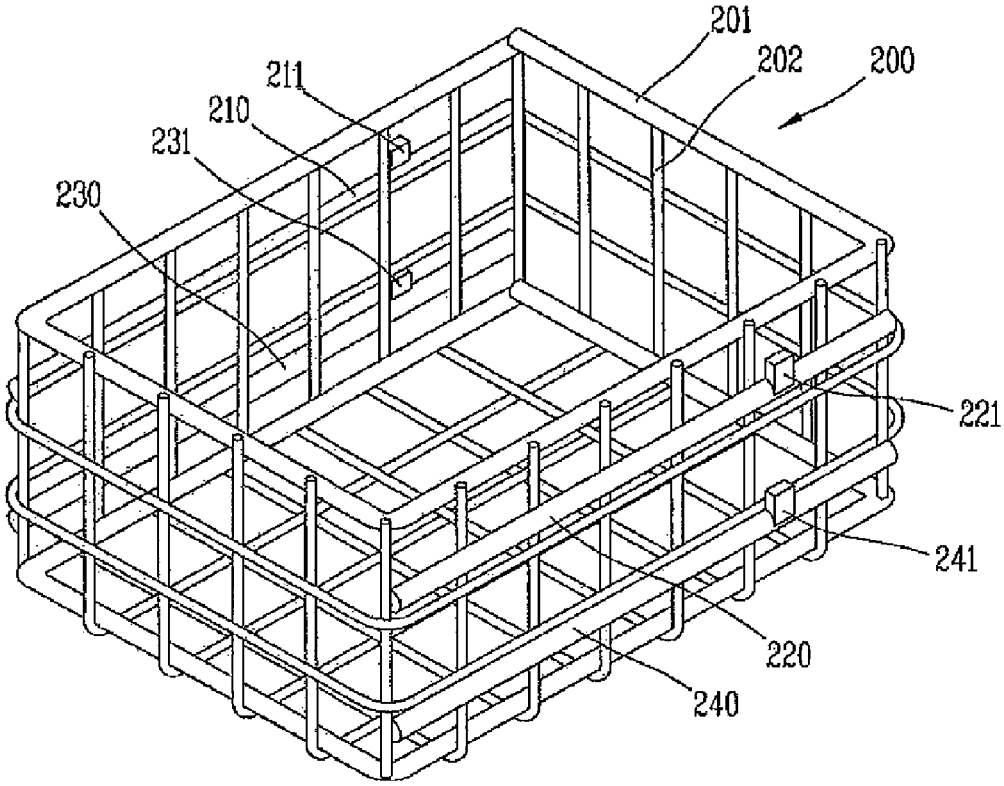
FIG. 2 is a perspective view showing a rack employed in the rack apparatus in accordance with the first exemplary embodiment of the present invention.
Figure 3:
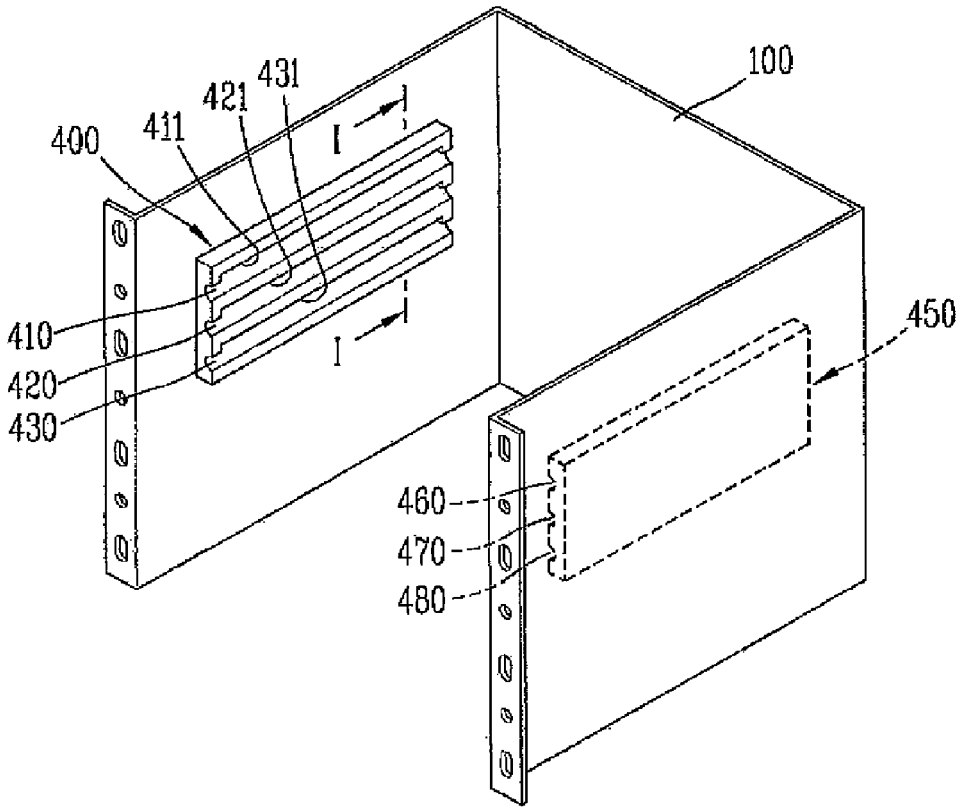
FIG. 3 is a perspective view showing a wash tub having rail guides employed in the rack apparatus in accordance with the first exemplary embodiment of the present invention.
Figure 4:
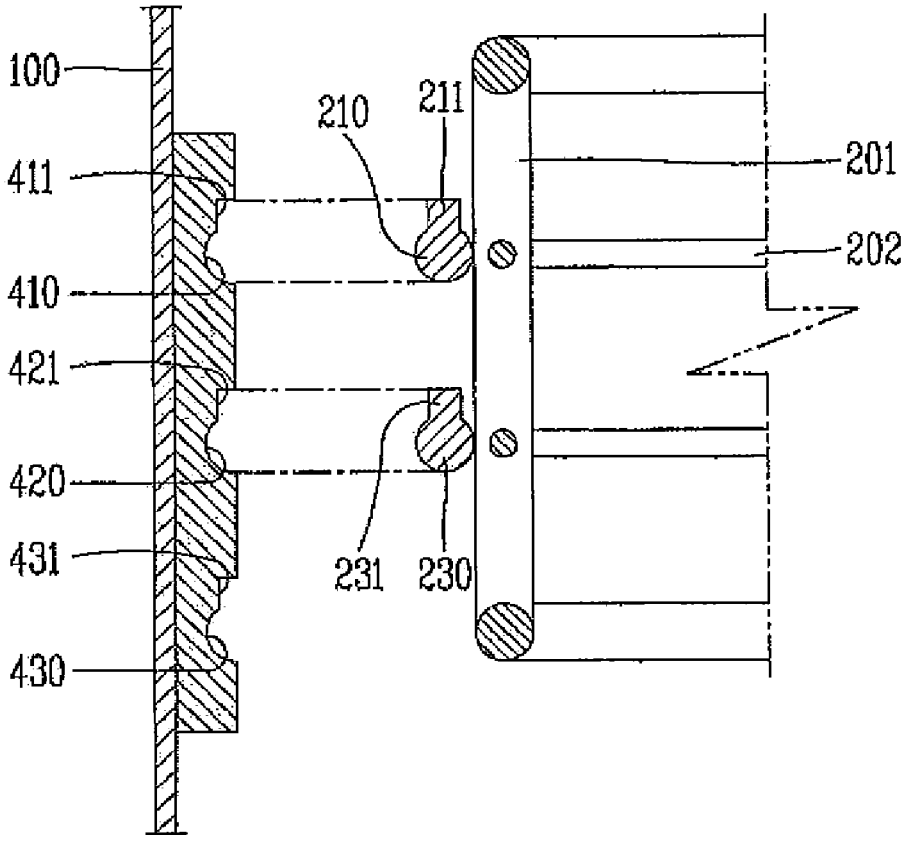
FIG. 4 is a cross-sectional view showing a coupled state between the rail guides and the rack taken along the line I-I' of FIG. 3.

FIG. 2 is a perspective view showing a rack employed in the rack apparatus in accordance with the first exemplary embodiment of the present invention, FIG. 3 is a perspective view showing a wash tub having rail guides employed in the rack apparatus in accordance with the first exemplary embodiment of the present invention, and FIG. 4 is a cross-sectional view showing a coupled state between the rail guides and the rack taken along the line I-I' of FIG. 3.

As shown in FIGS. 2 to 4, the rack apparatus according to the first exemplary embodiment may include a rack 200 and rail guides 400 and 450.

The rack 200 is configured to contain dishes, targets to be washed in the dishwasher 100. Such rack 200 includes a rack frame 201 configuring a hexahedral frame, and meshes 202 formed at surfaces defined by the rack frame 201 excluding an upper surface. Washing water can flow through the meshes 202 but dishes can be kept accommodated therein.

An upper left rack rail 210 and a lower left rack rail 230 are longitudinally installed at a left side surface of the rack 200. An upper right rack rail 220 and a lower right rack rail 240 are longitudinally installed at a right side surface of the rack 200.

The rack rails 210, 220, 230 and 240 are installed at the right and left side surfaces of the rack 200 to extend in a back and forth direction. The rack rails 210, 220, 230 and 240 are thusly slid together with the rack 200, such that the rack 200 can move along rail guides (see 400 and 450 of FIG. 3). Each body of the rack rails 210, 220, 230 and 240 is engaged with each rail groove (see 410, 420, 430, 460, 470 and 480 of FIG. 3) of the rail guides 400 and 450.

Rear sides of the rack rails 210, 220, 230 and 240 are provided with stoppers 211, 221, 231 and 241. The stoppers 211, 221, 231 and 241 protrude upwardly from the bodies of the rack rails 210, 220, 230 and 240, respectively. The stoppers 211 and 231 slide within stopper moving holes (e.g., 411, 421 and 431 of FIG. 3) of the rail guides 400, and contact with front and rear ends of the stopper moving holes 411, 421 and 431, thereby restricting the movement range of the rack 200. Such stoppers 211, 221, 231 and 241 can prevent the rack 200 from being freely separated from the rail guides 400 and 450.

The rail guides 400 and 450 are coupled to left and right inner side surfaces of the wash tub 110. The rail guides 400 and 450 are coupled so as to allow the left and right sides of the rack 200 to be movable. The rail guides 400 and 450 guide the sliding motion of the rack rails 210, 220, 230 and 240, such that the rack 200 can be extended from the wash tub 110 or be retracted in the wash tub 110.

Hereinafter, the left side rail guide 400 will be described, and such description will be equally applied to the right side rail guide 450.

An upper rail groove 410, an intermediate rail groove 420 and a lower rail groove 430 are longitudinally formed in the left side rail guide 400 with a certain height difference therebetween. The upper rail groove 410, the intermediate rail groove 420 and the lower rail groove 430 are configured to penetrate in a back and forth direction of the left rail guide 400.

The rail grooves 410, 420 and 430 are engaged with the upper left rack rail 210 and the lower left rack rail 230 of the rack 200. In detail, the upper left rack rail 210 and the lower left rack rail 230 may be engaged with a pair of upper side rail groove 410 and intermediate rail groove 420 or a pair of intermediate rail groove 420 and lower rail groove 430. The plurality of pairs of the rail grooves 41, 420 and 430 and the rack rails 210 and 230 implement support points, respectively, so as to divide and support the load of the rack 200.

With such configuration, since the height of the rack 200 is changeable, the height of the rack 200 can be adjusted according to requirements, such as the size of dish to be contained or the like.

Also, a pair of rail grooves 410, 420 and 430 are engaged with a pair of rack rails 210 and 230. Accordingly, the load of the rack 200 can be divided and supported at least two portions of the rail guide 400 along a direction in which the load of the rack 200 is applied. Therefore, the supporting force for the rack 200 can be enhanced, such that the rack 200 can safely move and the weight of dishes to be contained in the rack 200 can increase.

Here, it has been described that the pair of rail grooves 410, 420 and 430 are engaged with the pair of rack rails 210 and 230; however, it is merely illustrative. That is, other embodiments in which the more number of rail grooves are engaged with the more number of rack rails may be proposed, which will be covered by the scope of the present invention.

In the meantime, stopper moving holes 411, 421 and 431 are formed in upper sides of the rail grooves 410, 420 and 430, respectively. The stopper moving holes 411, 421 and 431 are configured to communicate respectively with the rail grooves 410, 420 and 430 and have front and rear ends blocked.

The stoppers 211 and 231 of the rack rails 210 and 230 can move back and forth in the stopper moving holes 411, 421 and 431, cooperating with the movement of the rack rails 210 and 230. The stopper 211 and 231 can be stopped by being blocked at front and rear ends of the stopper moving holes 411, 421 and 431.

Figure 5:
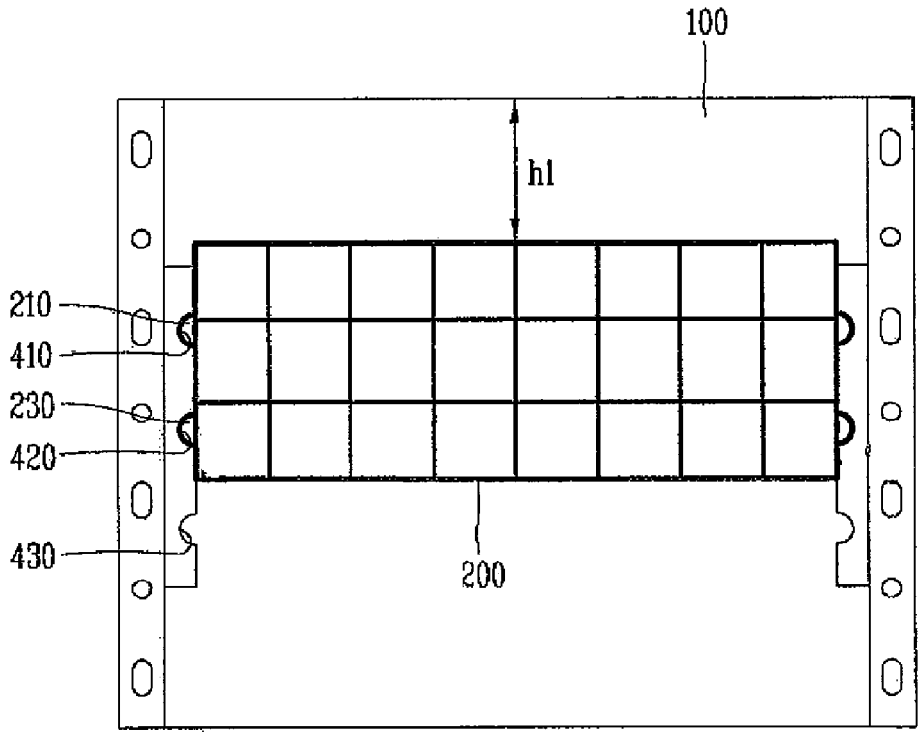
FIG. 5 is a front view showing a coupled state of the rack to the upper sides of the rail guides in accordance with the first exemplary embodiment of the present invention.
Figure 6:
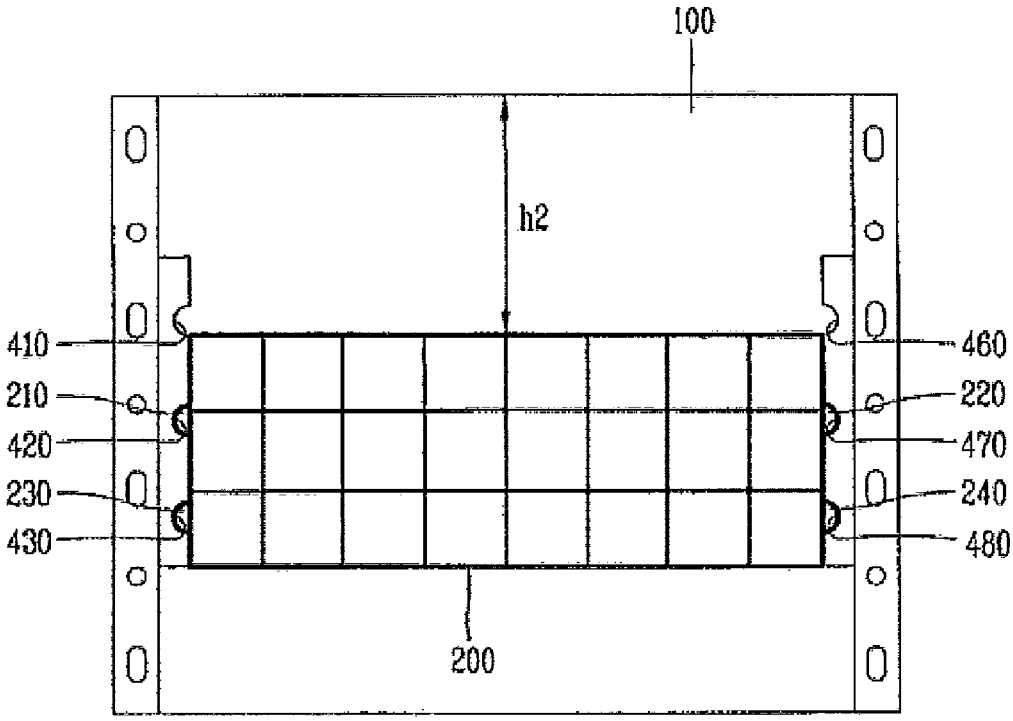
FIG. 6 is a front view showing a coupled state of the rack to the lower sides of the rail guides in accordance with the first exemplary embodiment of the present invention.

FIGS. 5 and 6 are views showing that the height of the rack of the rack apparatus is adjusted at the rail guides in accordance with the first exemplary embodiment of the present invention.

FIG. 5 is a front view showing a coupled state of the rack to the upper sides of the rail guides in accordance with the first exemplary embodiment of the present invention, and FIG. 6 is a front view showing a coupled state of the rack to the lower sides of the rail guides in accordance with the first exemplary embodiment of the present invention.

Hereinafter, description will be given of how the height of the rack of the rack apparatus is adjusted in accordance with the first exemplary embodiment, with reference to FIGS. 5 and 6.

As shown in FIGS. 5 and 6, the upper left rack rail 210 and the lower left rack rail 230 are movably coupled to the upper rail groove 410 and the intermediate rail groove 420 of the left rail guide 400, respectively. Also, the upper right rack rail 220 and the lower right rack rail 240 are movably coupled to the upper rail groove 460 and the intermediate rail groove 470 of the right rail guide 450, respectively.

Accordingly, the rack 200 is spaced apart from the upper end of the wash tub 110 by a certain height h1. Supporting forces are applied respectively to the pair of the upper rail groove 410 and the upper left rack rail 210 of the left rail guide 400 and the pair of intermediate rail groove 420 and the lower left rack rail 230 of the left rail guide 400. Also, supporting forces are applied respectively to the pair of upper rail groove 460 and the upper right rack rail 220 of the right rail guide 450 and the pair of the intermediate rail groove 470 and the lower right rack rail 240 of the right rail guide 450.

As shown in FIG. 6, the height of the rack 200 can be adjusted according to requirements, such as the sizes of dishes to be contained, the weight of such dishes, and the like.

In detail, the upper left rack rail 210 and the lower left rack rail 230 are movably coupled to the intermediate rail groove 420 and the lower rail groove 430 of the left rail guide 400, respectively. Also, the upper right rack rail 220 and the lower right rack rail 240 are movably coupled to the intermediate rail groove 470 and the lower rail groove 480 of the right rail guide 450, respectively.

Accordingly, the rack 200 can be spaced apart from the upper end of the wash tub 110 with a certain height h2 higher than the height h1. Supporting points are defined at the pair of the intermediate rail groove 420 and the upper left rack rail 210 of the left rail guide 400 and the pair of lower rail groove 430 and the lower side rack rail 230 of the left rail guide 400. Also, supporting points are defined at the pair of intermediate rail groove 470 and the upper right rack rail 220 of the left rail guide 450 and the pair of lower rail groove 480 and the lower right rack rail 240.

As such, the plurality of supporting points are defined between the rack 200 and the rail guides 400 and 450, such that the height of the rack 200 can be easily varied according to the requirements.

Hereinafter, a second embodiment of the present invention will be described with reference to the drawing. For the sake of brief explanation, the same configuration can be understood by the previous description thereof, and thusly it will not be repeated.

Figure 7:
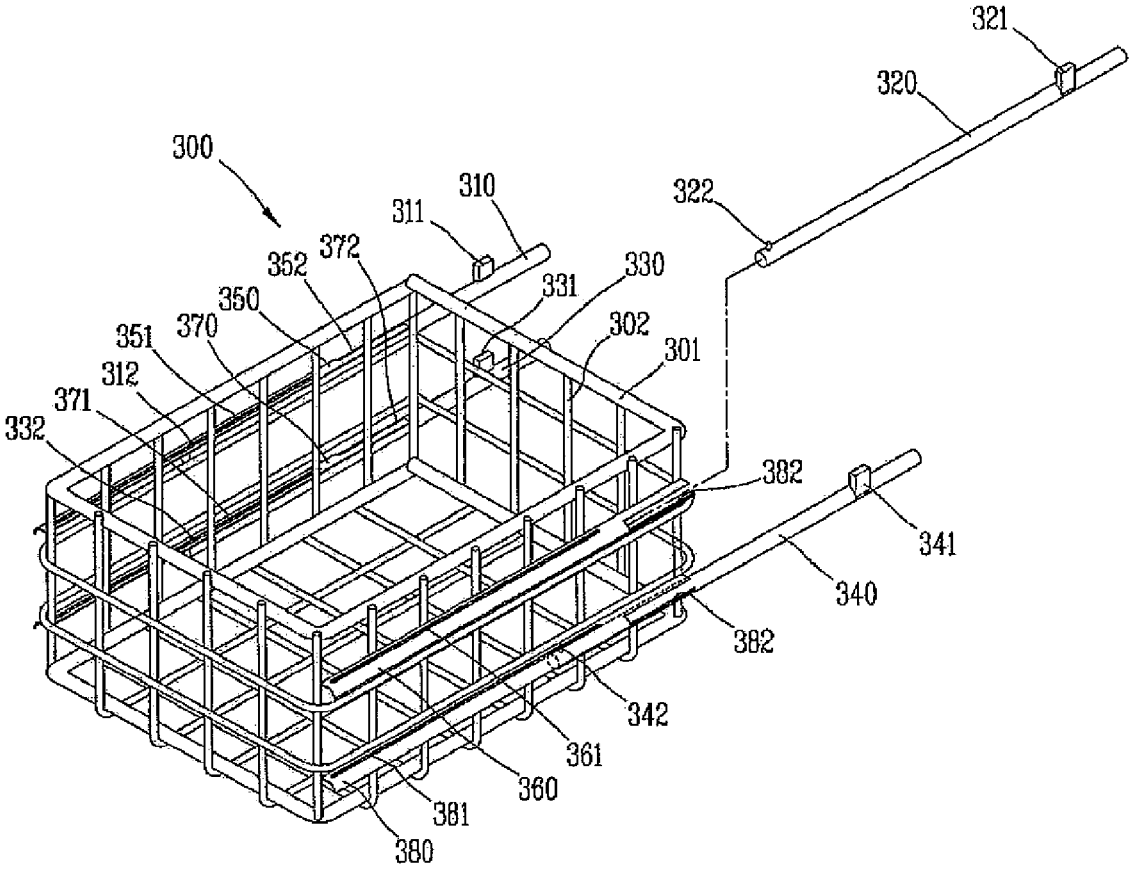
FIG. 7 is a perspective view showing a rack employed in a rack apparatus in accordance with a second embodiment of the present invention.

FIG. 7 is a perspective view showing a rack employed in the rack apparatus in accordance with a second embodiment of the present invention.

As shown in FIG. 7, a rack 300 configuring part of the rack apparatus in accordance with the second exemplary embodiment of the present invention may include, at its both side surfaces, an upper left supporting cover 350, a lower left supporting cover 370, an upper right supporting cover 360 and a lower right supporting cover 380.

An upper left rack rail 310, a lower left rack rail 330, an upper right rack rail 320 and a lower right rack rail 340 are movably coupled respectively to the upper left supporting cover 350, the lower left supporting cover 370, the upper right supporting cover 360 and the lower right supporting cover 380. Each of the covers 350, 360, 370 and 380 is configured to cover each of the rack rails 310, 320, 330 and 340.

With such configuration, the rack 300 can be slid along the rack rails 310, 320, 330 and 340. Thus, the rack rails 310, 320, 330 and 340 forwardly move along the rail guides 400 and 500, and thusly the rack 300 can further forwardly move along the rack rails 310, 320, 330 and 340. Accordingly, the rack 300 can further move forwardly in an increased range. Therefore, it is facilitated to contain dishes in the rack 300.

Protrusion moving grooves 351, 361, 371 and 381 are formed at front portions of the supporting covers 350, 360, 370 and 380, respectively. Forward move restricting protrusions 312, 322, 332 and 342 which are movably inserted in the protrusion moving grooves 351, 361, 371 and 381 are formed at front portions of the rack rails 310, 320, 330 and 340.

The forward move restricting protrusions 312, 322, 332 and 342 move in the protrusion moving grooves 351, 361, 371 and 381, respectively. After the movement, the forward move restricting protrusions 312, 322, 332 and 342 are blocked by the rear ends of the protrusion moving grooves 351, 361, 371 and 381, respectively. Accordingly, the supporting covers 350, 360, 370 and 380 and the rack 300 coupled thereto are restricted from the forward movement, thereby preventing the separation of the rack 300.

Stopper suspending portions 352, 362, 372 and 382 are formed at rear portions of the supporting covers 350, 360, 370 and 380. Stoppers 311, 321, 331 and 341 capable of being blocked by the stopper suspending portions 352, 362, 372 and 382 are formed at rear portions of the rack rails 310, 320, 330 and 340.

The stoppers 311, 321, 331 and 341 are suspended by the stopper suspending portions 352, 362, 372 and 382, respectively. Accordingly, the supporting covers 350, 360, 370 and 380 and the rack 300 coupled thereto are restricted from a backward movement, thereby preventing an impact between the rack 300 and the wash tub 110.

In the meantime, it has been described in every embodiment that the rack is supported in the wash tub at both side surfaces thereof; however, the present invention is not limited thereto, but it may be considered that the rack is supported only at any one side surface thereof. Such embodiment may be appropriate for a relatively small dishwasher, and also contributory to the reduction of an entire size of the dishwasher.

According to a rack apparatus of a dishwasher of the present invention, a plurality of rail grooves formed in rail guides installed at the wash tub can be engaged with rack rails formed at a rack, so as to enable an adjustment of the height of the rack. Thus, the height of the rack can easily be adjusted according to requirements, such as dishes to be contained in the rack.

Also, in the rack apparatus of the dishwasher, as the plurality of rail grooves are engaged with the rack rails, the load of the rack can be divided and supported at least two portions of the rail guides. Therefore, the supporting force for the rack can be enhanced, which allows the rack to move more safely, thereby increasing the weight of dishes to be contained in the rack.

The present invention has been explained with reference to the embodiments which are merely exemplary. It will be apparent to those skilled in the art that various modifications and variations can be made in the present invention without departing from the spirit or scope of the invention. Thus, it is intended that the present invention cover modifications and variations of this invention provided they come within the scope of the appended claims and their equivalents.

What is claimed is:

1. A rack apparatus of a dishwasher comprising:

a rack disposed in the dishwasher for washing targets contained in a wash tub, the rack configured to receive the targets;

supporting covers fixedly installed at both side surfaces of the rack;

a protrusion moving groove formed in each of the supporting covers;

rack rails slidably supporting the supporting covers in such a manner that the supporting covers are separated from the rack rails by lifting the rack upwardly;

rail guides, each rail guide having a plurality of rack rail supporting portions longitudinally disposed at the wash tub and configured to slidably support the rack rails; and a restriction protrusion formed on each rack rail, the restriction protrusion configured to be movably inserted in one of the protrusion moving grooves in order to restrict a moving range of the rack with respect to the rack rails.

2. The apparatus of claim 1, wherein a plurality of the rack rails are installed at one side surface of the rack, at least two rack rails of the plurality of the rack rails being simultaneously coupled to the rack rail supporting portions.

3. The apparatus of claim 1, wherein a plurality of rack rails are installed at both side surfaces of the rack, respectively, and at least two rack rails of the plurality of rack rails installed at one side surface are simultaneously coupled to the rack rail supporting portions.

4. The apparatus of claim 2 or 3, wherein the rack rail supporting portions include rail grooves formed in each rail guide along a sliding direction of the rack rails.

5. The apparatus of claim 4, wherein a stopper for restricting the sliding range of the rack is formed at one of each rack rail supporting portion and each rack rail, and contact portions cooperating with the stopper are formed at the other one thereof.

6. The apparatus of claim 5, wherein the contact portions are formed at both end portions either of the rack rail supporting portions or the rack rails.

7. The apparatus of claim 4, wherein, the rack rails are slid by being received in bottom surfaces of the rail grooves.

8. A rack apparatus of a dishwasher comprising:

a rack disposed in the dishwasher for washing targets contained in a wash tub, the rack configured to receive the targets to be washed;

supporting covers fixedly installed at both side surfaces of the rack;

a protrusion moving groove formed in each of the supporting covers;

rack rails slidably supporting the supporting covers in such a manner that the supporting covers are separated from the rack rails by lifting the rack, rail guides, each rail guide having a plurality of rack rail supporting portions longitudinally disposed at the wash tub and configured to slidably support the rack rails; and a restriction protrusion formed on each rack rail, the restriction protrusion configured to be movably inserted into one of the protrusion moving grooves in order to restrict a moving range of the rack with respect to the rack rails, wherein the rack rails are simultaneously coupled to two or more rack rail supporting portions.

9. The apparatus of claim 8, wherein the rack rails are installed at one side surface of the rack.

10. The apparatus of claim 8, wherein the rack rails are installed at both side surfaces of the rack.

11. The apparatus of claim 9 or 10, wherein the rack rail supporting portions include rail grooves formed at each rail guide along a sliding direction of the rack rails.

* * * * *